US006454665B2

(12) United States Patent
Antonious

(10) Patent No.: US 6,454,665 B2
(45) Date of Patent: Sep. 24, 2002

(54) IRON TYPE GOLF CLUB HEAD

(76) Inventor: Anthony J. Antonious, 7738 Calle Facil, Sarasota, FL (US) 34238

( * ) Notice: Subject to any disclaimer, the term of this patent is extended or adjusted under 35 U.S.C. 154(b) by 0 days.

(21) Appl. No.: 09/725,024

(22) Filed: Nov. 29, 2000

Related U.S. Application Data

(63) Continuation-in-part of application No. 09/447,711, filed on Nov. 23, 1999.

(51) Int. Cl.[7] ..... A63B 53/04
(52) U.S. Cl. ..... 473/346; 473/350
(58) Field of Search ..... 473/324, 325, 473/326, 327, 328, 329, 330–344, 347, 348, 349, 350, 290, 291, 292, 293, 345, 346; D21/747, 748, 749, 750, 751

(56) References Cited

U.S. PATENT DOCUMENTS 3,814,437 A * 6/1974 Winquist
4,326,326 A * 4/1982 MacDonald
4,826,172 A * 5/1989 Antonious
4,938,470 A * 7/1990 Antonious
5,014,993 A * 5/1991 Antonious
D319,857 S * 9/1991 Antonious
5,048,835 A * 9/1991 Gorman
5,074,563 A * 12/1991 Gorman
D329,266 S * 9/1992 Antonious
D332,478 S * 1/1993 Antonious
5,290,032 A * 3/1994 Fenton
5,328,184 A * 7/1994 Antonious
5,390,924 A * 2/1995 Antonious
5,395,113 A * 3/1995 Antonious
5,435,559 A * 7/1995 Swisshelm
5,549,297 A * 8/1996 Mahaffey
6,027,415 A * 2/2000 Takeda

* cited by examiner

*Primary Examiner*—Sebastiano Passaniti
(74) *Attorney, Agent, or Firm*—Welsh & Flaxman LLC

(57) ABSTRACT

An iron type golf club head having a unique weighting, stabilizing and reinforcing configuration for the rear face of a cavity back, peripheral weight club head. At least one dominant secondary weight member is combined with at least one auxiliary reinforcing and stabilizing weight member extending from an innermost secondary weight member surface across the rear face of the rear cavity.

7 Claims, 9 Drawing Sheets

500
536
537
538
518
530
532
534

600
636
637
618
632
634
638
630
632

700

736
737
728
730
716
734
732
738

800

815
834
832
830
836
837
838

900
938
918
937
936
930
916
934
928
932

1000
1035
1018
1034
1036
1030
1016

1100
1118
1128
1130
1116
1134
1136
1132
1135
1126

1218
1200
1228
1237
1236
1230
1216
1234
1232
1235

2300
2326
2328
2324
2330
2323

2400
2436
2437
2418
2416
2434
2435

2500
2526
2524
2532
2520
2522
2530

2500
2520
2526
2530
2528
2532
2534
2522
2523

2700
2720
2724
2728
2732
2722
2730
2726

2800
2824
2820
2828
2832
2822
2830
2826

2900
2920
2924
2928
2932
2934
2922
2930
2926

3000
3020
3024
3032
3022
3034

3100
3120
3124
3132
3130
3124
3126
3122

3200
3224
3220
3232
3226
3222

3300
3324
3334
3332
3338
3322
3330
3320
3326
3336

IRON TYPE GOLF CLUB HEAD

RELATED APPLICATION

The present application is a continuation-in-part of Ser. No. 09/447,711 filed Nov. 23, 1999 for IRON TYPE GOLF CLUB.

BACKGROUND AND SUMMARY OF THE INVENTION

The present invention relates to golf clubs and, in particular, to iron type golf club heads having an improved weight distribution at the rear club face.

Iron type golf club heads have been designed with a number of different weighting systems to improve the shot making characteristics of golf clubs. Examples of patents which disclose weighting systems for golf club heads include my own U.S. Pat. Nos. 5,395,113, 5,046,733, 5,014,993, 5,011,151, 4,938,470, 4,932,658, 4,919,431, 4,919,430, 4,915,386, 4,907,806 and 4,826,172. Bypass the U.S. Pat. No. 4,826,172. Additional patents of interest are U.S. Pat. No. 3,814,437 to Winquist, U.S. Pat. No. 5,290,032 to Fenton et al. and U.S. Pat. No. 5,595,552 to Wright et al.

The present invention is directed to a weighting system for use within the boundaries of the rear peripheral weight and within the rear cavity of a peripheral weighted golf club head which represents an improvement over the known prior art. The iron type golf club of the present invention includes a golf club head having a hosel, a body portion including a heel, toe, sole, top ridge, ball striking face with a loft greater than 12 degrees, a leading edge defined by the inner section of the ball striking face and the forwardmost progression of the bottom sole, and a rear surface of the of club face. In the preferred embodiments, the rear surface of the club face includes a primary peripheral weight extending around the outer perimeter of the club head which forms an inner cavity having a recessed rear face and an inner ledge or shelf like surface around the inner periphery of the peripheral weight. The present invention contemplates the use of at least a single dominant controlling secondary weight member, in addition to the outer primary peripheral weight, located on the inner peripheral shelf and having at least one auxiliary reinforcing and stabilizing weight member extending outwardly therefrom. The present invention further provides a unique secondary weighting system that includes two opposing, dominant secondary weighting members that are unitized by at least one connecting auxiliary weight and reinforcing member. This creates a formidable barbell shaped structure for placing substantial mass at preferred exact locations on the back of the club face surface. The barbell shaped weight distribution and reinforcing structure permits optimum transfer of energy when a golf ball is struck while simultaneously providing a reinforcing and stabilizing structure behind the width of the club face where ball contact occurs. Adverse effects from twisting, torqueing and knock-back, are minimized or completely eliminated when a golf ball is struck off center. The barbell weight distribution and reinforcing structure permits all caliber of golfers to greatly improve their shot making. Golfers quickly gain confidence that the unique design of this invention is a substantial improvement over other conventional golf clubs they may have been familiar with. The present invention provides a more solid feel and a resistance to adverse effects created by off center hits such that golf balls travel further and straighter on a more consistent basis. Most noteworthy, the barbell, weight and reinforcing structure is very impressive with or without adding heavier or more dense materials to the club head.

A still further improvement is the use of high density metal material such as tungsten inserts as a part of a secondary weight and reinforcing system in certain embodiments of the present invention.

Furthermore, this invention permits controlling or avoiding any trampoline effect on golf club faces because of the increased strength and stability of the multiple auxiliary reinforcing and stabilizing weight members, thus allowing the club face to be made with variable thicknesses while still keeping within the guidelines relating to golf club conformance as set forth in the Rules of Golf.

The present invention creates the formation of an improved variably located, dominant secondary weighting and reinforcing system within the back cavity of a golf club including at least one cooperating auxiliary reinforcing member extending outwardly from the secondary weight member. Embodiments in accordance with this invention also uniquely locate substantially more effective weight in an upper portion of the cavity at the rear of the club head in back of the ball striking face. This secondary weight member and the cooperating auxiliary reinforcing and stabilizing weight members, extending inwardly into the rear cavity, place substantial weight closer to the center of the club face creating a larger more supporting and forgiving impact zone, especially when off-center ball contacts occurs. This capability permits the production of club heads with club faces that are more responsive for controlling shots that produce a variety of preferred shot making results such as lower trajectory, desired distances and accurate ball flight while minimizing or overcoming penalizing, negative lateral direction, as occurs when a ball is sliced or hooked. Improved direction and distance control and other playing advantages are experienced especially around the greens. The club head in accordance with the present invention produces a better feel and enhances executing critical shots requiring touch and finesse when the club is used for chip or pitch shots close to the green.

The unique innovation of a dominant secondary weight member located adjacent the peripheral weight mass and the cooperating auxiliary reinforcing and stabilizing weight members, extending outwardly therefrom, provides an extraordinary combination of mass closer to the center of the club head and/or behind the impact zone where ball contact occurs on the club face. Much more concentrated mass is available, precisely where it is most needed at impact. This structure transfers significantly greater energy that produces the optimum force that results in increased club head control and stability for increased distance and repeating accuracy.

In summary, the basic concept of the present invention provides more versatility than any prior art for iron-type club heads. It functions in a different manner to produce different results. The unique overall structural design, can be formed within the back cavity, at four opposing sections of the club head . . . upper or lower section, toe or heel section.

Each adaptation produces various preferred results. Forming the concept at the lower location, in the cavity, enhances the higher handicap golfers' performance . . . facilitates getting balls airborne, in a higher trajectory and also produce better results when "thin" ball contacts occur.

Forming the concept at the upper location, within the cavity, produces a much lower ball trajectory preferred by the lower handicap golfers. Forming the concept at the toe section, within the cavity, increases the "feeling of the club head's closing rotation", as it makes ball contact. This enhances the chances of higher handicap golfers making more "square face" solid-ball contacts.

Forming the concept at the heel section, within the cavity, provides an unusual amount of mass, particularly located, adjacent the base of the hosel. Providing this considerable mass at this critical location on the club head, dramatically resists the negative effects from twisting, torqueing and even optimizes the Moment of Inertia, when off-center balls contacts occur. Since the hosel is the "axis" of the club head, as it is swung, the substantial additional mass available for awry-hits, provides a formidable built-in means to effectively minimize the margin of human error for all caliber of golfers.

The concept of this invention provides a considerably larger mass of the dominant secondary weighting system, including auxiliary cooperating reinforcing and stabilizing members, all located within the back cavity of the club head. The cooperating auxiliary reinforcing and stabilizing members extend from the dominant secondary weight and form probe-like extensions to the back of the impact area of the club face. The reinforcing and stabilizing members act as energizing conduits to expand the most effective hitting area, directly behind the impact area. The system permits a faster acceleration of energy transfer, directly to the precise point and at the exact instant ball contact occurs, on the club face. This creates a greater energized impact area on the club face that produces a larger "sweet spot" for optimum results, even for off-center hits.

Several of the preferred embodiments include three elongated probe like auxiliary reinforcing and stabilizing members. They extend angularly from and are combined with the dominant larger mass secondary weighting member, to create a much larger premium hitting area on the club face at impact. The concept of the present invention permits increased flexible adaptation for individual specialty wedge-type club heads or producing iron type club heads, combining the preferred functional design requirements, for complete sets of club heads.

Other embodiments disclose secondary weight members and auxiliary reinforcing and stabilizing weight configurations in various multiples, sizes and variable placements, located on the rear surface behind the club face.

An object of the present invention is the provision of an iron type golf club head having at least one dominant secondary weight, and at least two auxiliary reinforcing and stabilizing weight member formed within the rear cavity of a peripheral weighted golf club.

Another object is the provision of an improved type golf club head having a unique weighting system which provides better feel, more stability and club head control with considerable increased energy transfer to a golf ball during the execution of a golf shot.

Another object is the provision of an improved type golf club head having a dominant secondary weight which provides mass and auxiliary reinforcing and stabilizing members extending in a variety of preferred directions onto the central rear section of the club head at the back of the club head face.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 17:
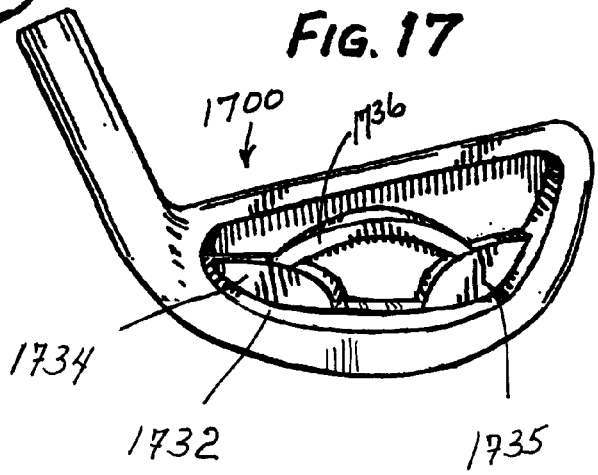
Figure 18:
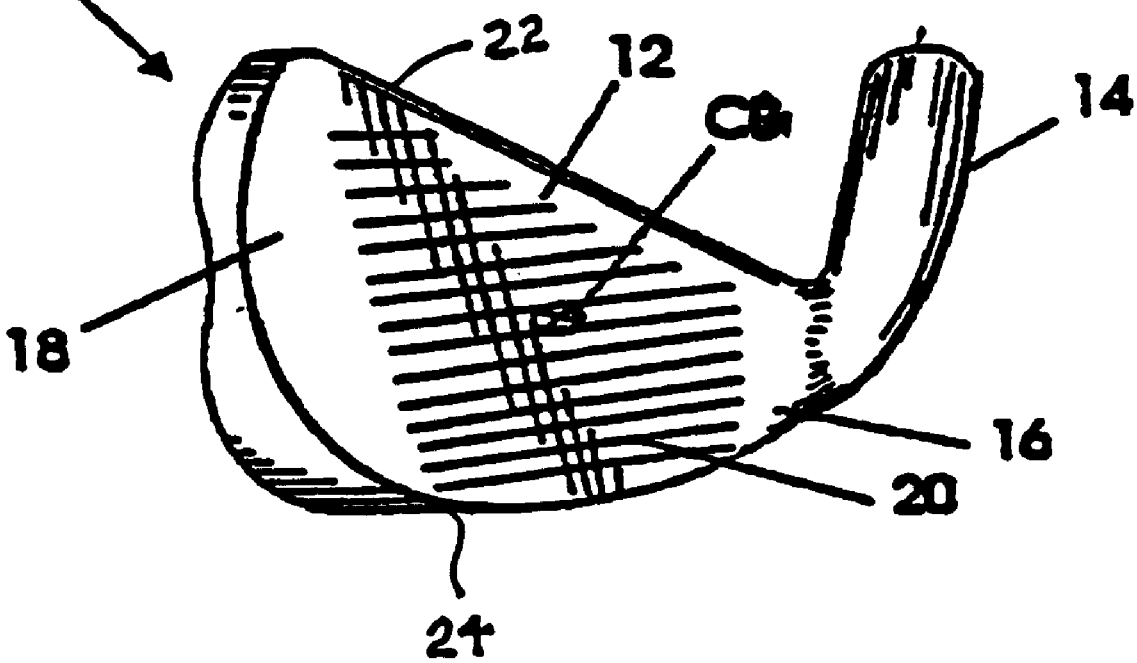
FIG. 18 is a front elevational view of an iron type golf club head in accordance with the present invention.

FIG. 18 illustrates an iron type golf club head in accordance with the present invention including, a club head body 12, a hosel 14, heel 16, toe 18, ball striking face 20, having a golf ball impact zone generally located at the center of the ball striking face 20 further defined as a center of gravity C. G. centrally located thereon, top ridge surface 22 and bottom sole 24. It will be appreciated that each of the embodiments described in FIGS. 1–17 and 19–33 include all conventional features and structural characteristics of the iron club head 10 described in this paragraph.

Figure 1:
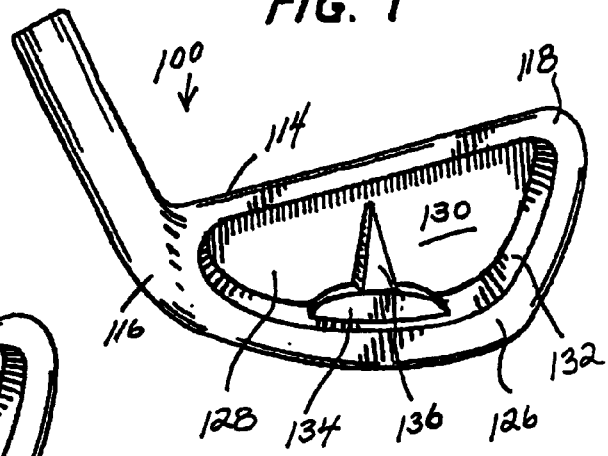
FIGS. 1–17 are rear perspective views of seventeen embodiments of iron type golf club heads in accordance with the present invention.

FIG. 1 illustrates a first embodiment of a golf club head 100 made in accordance with the present invention. While the illustrated golf club head is a cavity back, weighted club head with a primary perimeter weighting around the entire circumference, the present invention can also be applied to other iron type golf club heads having, for example reduced peripheral weight or no peripheral weight, as for example, the well known muscle back type golf irons. The club head body 114 includes a rear of primary peripheral weight 126, a rear face 128 and a rear cavity 130 formed by the peripheral weight 126. The inner edges of the primary peripheral weight 126 form a shelf 132 along the bottom, sides and upper portion of the rear cavity 130. In this embodiment, a secondary weight member 134, having a significant controlling mass, is located on and formed integrally with the rear face 128 and the peripheral shelf 132 of the peripheral weight 126 between the heel 116 and toe 118. An auxiliary stabilizing and reinforcing weight 136 is integrally formed with and extends upwardly from the secondary weight member 134 into the cavity 130 toward the center of the cavity 130 in a direction to the top ridge of the club head 100. Preferably, the auxiliary weight and reinforcing member 136 is located at or closely adjacent the center of gravity CG of the club head 100. The lower surfaces of the secondary and auxiliary weight members 134, and 136 reinforcing member and are integrally formed with the rear face 128 of the cavity 130 to provide a solid, more stabilized unitary structure at the rear of the club head 100.

Figure 2:
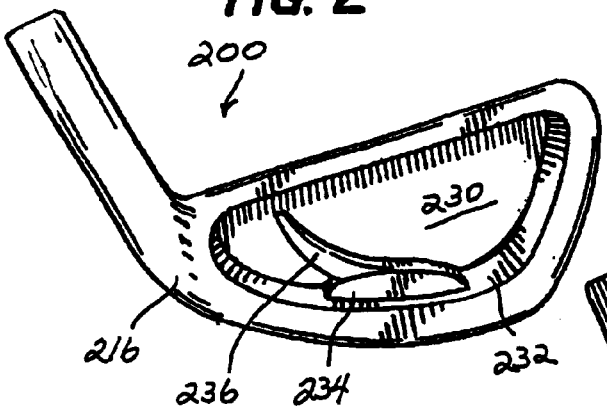

FIG. 2 shows a second embodiment of an iron type golf club head 200 in accordance with the present invention. In this embodiment, a dominant secondary weight 234 lies on a lower shelf 232 within a rear cavity 230 and includes an auxiliary, weight and reinforcing member 236 extending outwardly and upwardly from the dominant secondary weight member 234 toward the heel 216. This provides additional weight and reinforcing means toward the heel 216 for a golfer having a tendency to hit the ball at this location.

Figure 3:
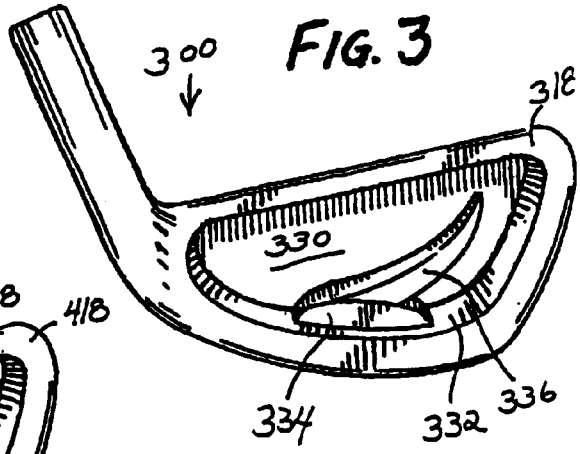

FIG. 3 shows a third embodiment of an iron type golf club head 300 in accordance with the present invention including a dominant secondary weight member 334 disposed on lower peripheral weight shelf 332 in a rear cavity 330 of club head 300. In this embodiment, an auxiliary weight 336 extends upwardly toward the toe 318 of the club head 300 and provides additional weight for golfers who tend to hit the ball at this location.

Figure 4:
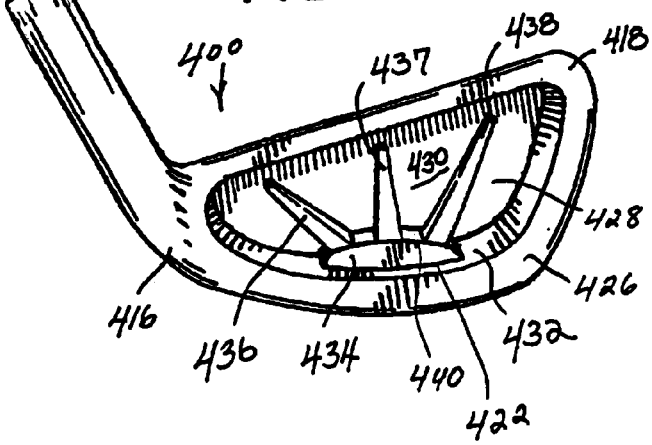

FIG. 4 shows a fourth embodiment of an iron type golf club head 400 with a heel 416, toe 418 and having a peripheral weight 426 forming a rear cavity 430 with a rear face 428. A dominant secondary weight member 434 has a first portion 422 located at and integrally formed on lower peripheral weight shelf 432 in rear cavity 430. A second upper portion 440 of dominant secondary weight member 434 extends outwardly from the peripheral weight 426 toward the center of the rear cavity 430. In this embodiment a plurality of three auxiliary reinforcing and stabilizing weights 436,437, 438 are attached to and extend upwardly and outwardly in diverging angular directions from the second portion 440 closest to the center of the cavity 430 and generally opposite the impact zone at the center of the ball striking face (not shown) on the opposite side of the club head 400 for optimum transfer of energy from the club head to a golf ball during impact. The three auxiliary reinforcing and stabilizing weights 436, 437, 438 extend toward the heel 416, the center of the cavity 430 and the toe 418 on the rear face 428 of the club head 400. Preferably the three auxiliary reinforcing and stabilizing weights 436, 437, 438 are elongated and taper to a point at the distal end farthest from the second portion of the secondary weight member 434. These auxiliary reinforcing and stabilizing weights 436, 437, 438 span a large part of the surface area of the rear face 428 of the club head 400 providing additional weight while acting as reinforcing and stabilizing members. The auxiliary reinforcing and stabilizing members 436, 437, and 438, extend from the dominant secondary weight member 434 attached to a portion of the primary peripheral weight 426, across the rear club face 428, toward but not touching, opposite portions of the primary peripheral weight 426.

Figure 5:
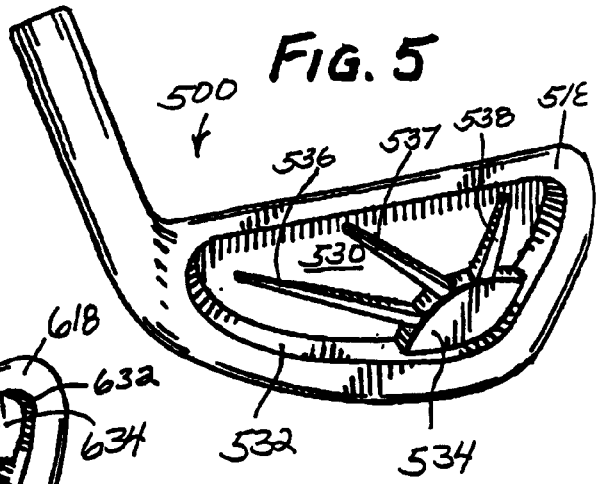

FIG. 5 shows a fifth embodiment of an iron type golf club head 500 in accordance with the present invention. A dominant, secondary weight member 534 is located on lower peripheral weight shelf 532 near the toe 518 of the club head 500. Auxiliary reinforcing and stabilizing weights 536, 537, 538 extend in opposing directions upwardly and outwardly from the dominant secondary weight 534 into cavity 530 of the club head 500.

Figure 6:
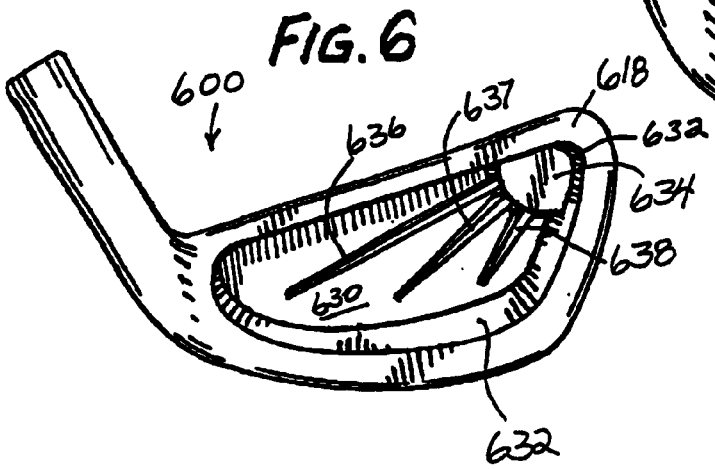

FIG. 6 shows a sixth embodiment of an iron type golf club head 600 in accordance with the present invention. A dominant secondary weight member 634 is located on peripheral weight shelf 632 at the upper toe portion 618 of the club head 600. A series of tapered auxiliary reinforcing and stabilizing weights 636, 637, 638 extend outwardly and downwardly in diverging directions from the secondary weight 634 across the rear face 628 behind the sweet spot, or center of gravity on the ball striking face, not shown of the cavity 630.

Figure 7:
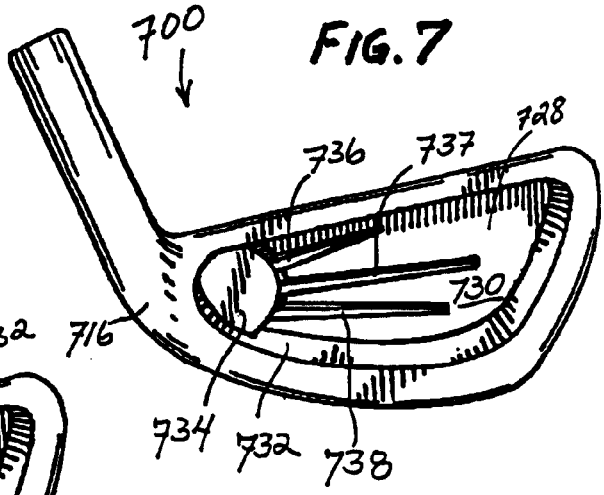

FIG. 7 shows a seventh embodiment of an iron type golf club head 700 in accordance with the present invention and includes a dominant secondary weight member 734 located on an upper peripheral weight shelf 732 and located adjacent the heel 716 of the club head 700. A series of elongated and tapered auxiliary reinforcing and stabilizing weights 736, 737, 738 extend outwardly in diverging directions across the rear face 728 into cavity 730 of the club head.

Figure 8:
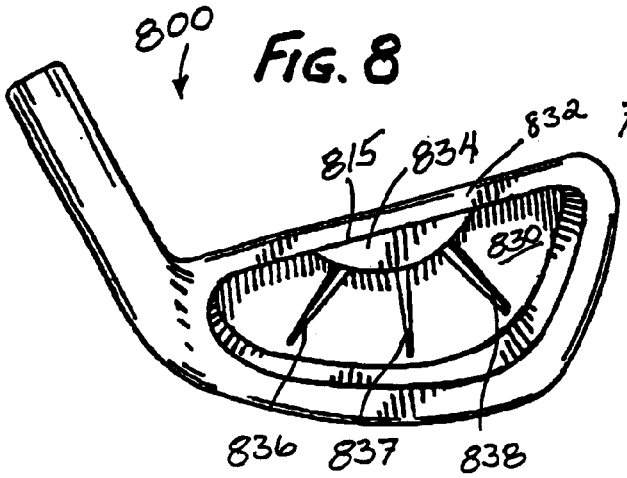

FIG. 8 shows an eighth embodiment of an iron type golf club head 800 in accordance with the present invention including a dominant secondary weight member 834 located along an upper shelf 815 of peripheral weight 832 A series of auxiliary reinforcing and stabilizing weights 836, 837, 838 extend downwardly from the secondary weight 834 across the rear face 828 into the cavity 830.

Figure 9:
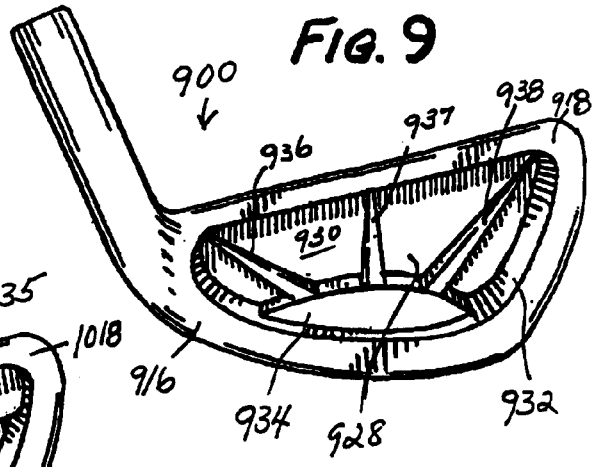

FIG. 9 shows a ninth embodiment of an iron type golf club head 900 in accordance with the present invention which is similar in structure to the embodiment shown in FIG. 4. In this embodiment, a dominant secondary weight member 934 lies on a lower peripheral weight shelf 932 and extends between the heel 916 and the toe 918 of the club head 900. In this embodiment, the secondary weight member 934 extends most of the way between the toe 918 and heel 916 along the shelf 932. Auxiliary reinforcing and stabilizing weights 936, 937, 938 extend upwardly and outwardly across the rear face 928 toward the heel 916, center and toe 918 of the club head 900 respectively.

Figure 10:
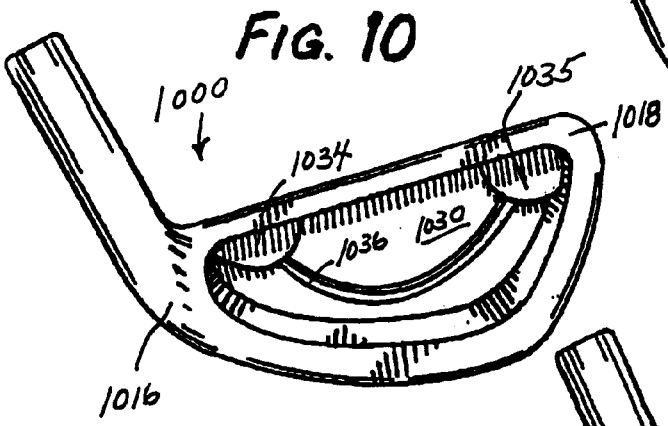

FIG. 10 shows a tenth embodiment of an iron type golf club head 1000 in accordance with the present invention and includes two opposing, dominant secondary weight members 1034 and 1035 located on an upper portion of cavity 1030 at the heel 1016 and toe 1018 of the club head 1000 respectively. The opposing secondary weight members 1034 and 1035 are connected by a single arcuate auxiliary reinforcing and stabilizing weight member 1036.

Figure 11:
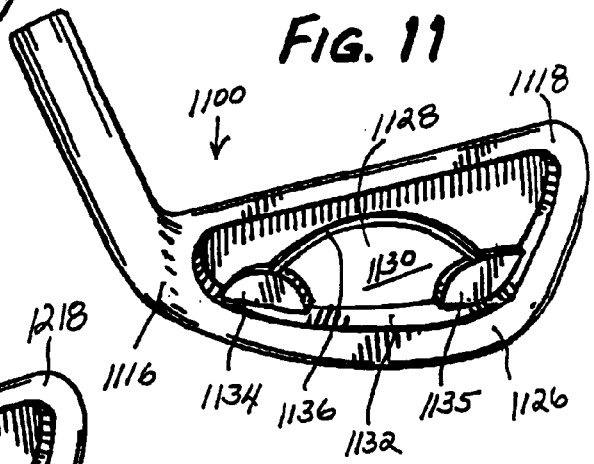

FIG. 11 shows an eleventh embodiment of an iron type golf club head 1100, in accordance with the present invention which is similar to the embodiment shown in FIG. 10. In this embodiment a pair of dominant secondary weight members 1134 and 1135 are located on a lower portion of an inner shelf 1132 formed by the peripheral weight 1126 and located adjacent the heel 1104 and toe 1106 respectively. The opposing secondary weight members 1134 and 1135 are connected by an arcuate auxiliary reinforcing and stabilizing weight 1136 across rear face 1128 of the rear cavity 1130.

Figure 12:
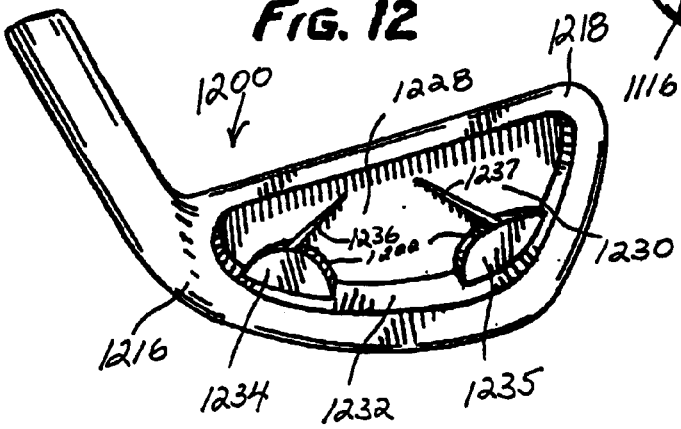

FIG. 12 shows a twelfth embodiment of a golf club head 1200 in accordance with the present invention and includes two opposing, dominant secondary weight members 1234 and 1235 formed at the heel 1216 and toe 1218 of the club head 1200 respectively. The secondary weight members 1234 and 1235 are integrally formed on a lower peripheral weight shelf 1232 and rear face 1228 of cavity 1230. In this embodiment auxiliary reinforcing and stabilizing weights 1236 and 1237 extend upwardly in diverging, inward directions across the rear face 1228 into the cavity 1230 from a top surface 1222 of the respective secondary weights 1234 and 1235.

Figure 13:
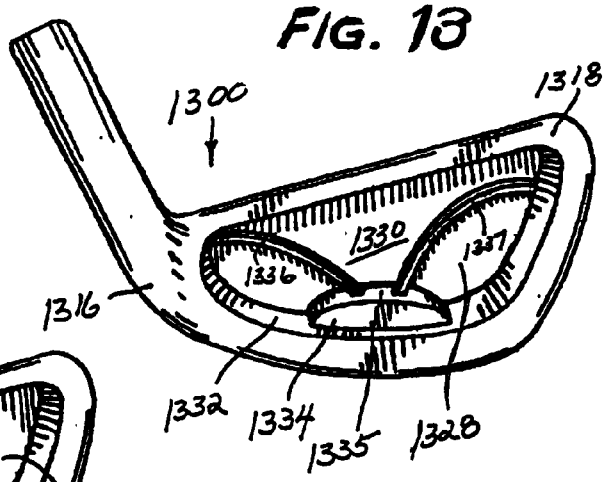

FIG. 13 illustrates a thirteenth embodiment of an iron type golf club head 1300 in accordance with present invention and includes a single dominant secondary weight member 1334 formed on a lower peripheral weight shelf 1332 and integral with rear face 1328 midway along the length of a lower portion of the cavity 1330. In this embodiment two auxiliary reinforcing and stabilizing weights 1336 and 1337 extend from an upper surface 1335 of the secondary weight 1334 to the heel 1316 and toe 1318 of the club head 1300 respectively.

Figure 14:
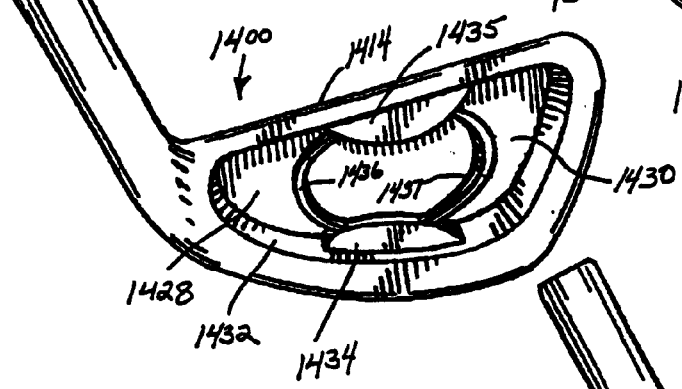

FIG. 14 shows a fourteenth embodiment of a iron type golf club head 1400 in accordance with the present invention including a pair of opposing dominant secondary weight members 1434 and 1435 formed adjacent peripheral weight shelf 1432 at the top and bottom of rear cavity 1430 integral with rear face 1428. In this embodiment opposing arcuate auxiliary reinforcing and stabilizing weights 1436 and 1437 are attached to and interconnect weight members 1434 and 1435.

Figure 15:
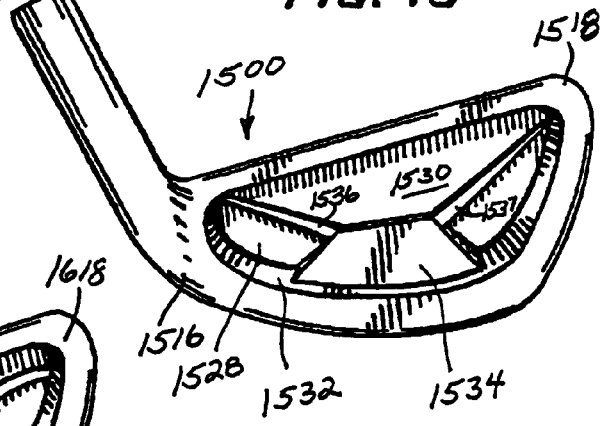

FIG. 15 illustrates a fifteenth embodiment of an iron type golf club head 1500 in accordance with the present invention. In this embodiment a single, dominant, secondary weight member 1534, generally trapezoidal in shape, is located on peripheral weight shelf 1532 in the cavity 1530 and integral with rear wall 1528 approximately midway between heel 1516 and toe 1518. Auxiliary reinforcing and stabilizing weights 1536 and 1537 extend upwardly toward the toe 1516 and heel 1518 respectively.

Figure 16:
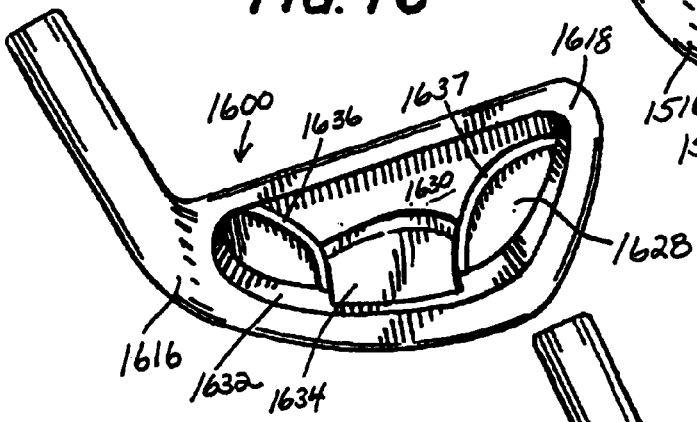

FIG. 16 shows a sixteenth embodiment of an iron type golf head 1600 in accordance with the present invention. In this embodiment a single secondary weight member 1634 is positioned on lower peripheral weight shelf 1632 approximately midway between heel 1616 and toe 1618 on rear face 1628 in cavity 1630. A pair of opposing arcuate auxiliary reinforcing and stabilizing weights 1636 and 1637 extend from edges of the weight member 1634 toward the heel 1616 and toe 1618 respectively.

FIG. 17 illustrates still another embodiment of an iron type golf club head 1700 in accordance with the present invention including a pair of opposing dominant secondary weight members 1734 and 1735 formed on lower peripheral weight shelf 1732. In this embodiment, a single arcuate, auxiliary reinforcing and stabilizing weight member 1736 connects the top surfaces of secondary weights 1734 and 1735.

FIGS. 19, 20, 21, 22 and 23 all show various embodiments of golf club heads 1900, 2000, 2100, 2200 and 2300 which use a variety of different shaped tungsten secondary weight inserts or molten tungsten forming a matrix retained in a cavity provided in the secondary weighting structure, in combination with auxiliary reinforcing members as described hereinabove. The tungsten inserts provide heavier weights than would normally exist if the weight member were integrally formed with the rear of the club head from the same material.

Figure 19:
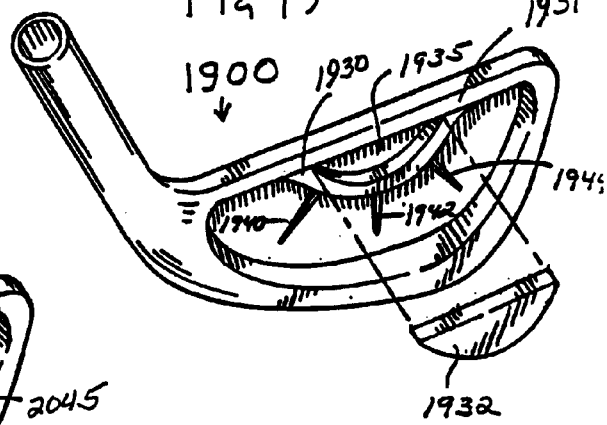
FIGS. 19 to 33 are rear views of fifteen additional embodiments in accordance with the present invention.

FIG. 19 shows a club head 1900 having a dominant secondary weight member 1930, formed on upper peripheral weight 1931, which is generally arcuate in shape with a cavity 1935. A tungsten insert 1932 is secured in the cavity 1935 by mechanical means, suitable adhesive or bonding materials. Auxiliary reinforcing and stabilizing weights 1940, 1942 and 1944 radiate downwardly from the upper secondary weight member 1930.

Figure 20:
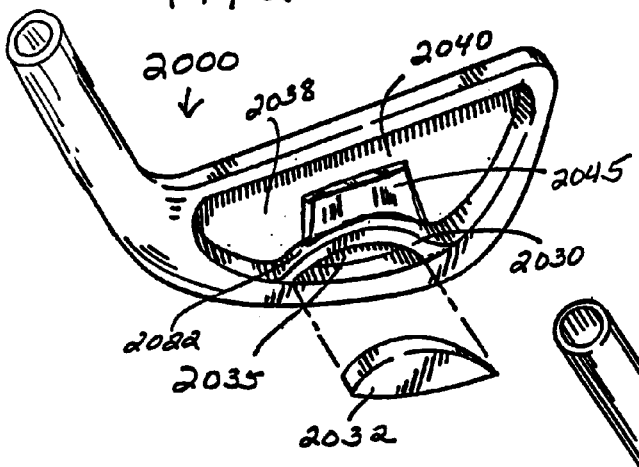

FIG. 20 shows a club head 2000 having a dominant secondary weight member 2030, generally arcuate in shape and formed with a cavity 2035. A tungsten insert is secured in the cavity 2035 on a lower portion of rear face 2040. A trapezoidal auxiliary reinforcing and stabilizing weight member 2045 extends upwardly from the top surface 2022 secondary weight member 2030 on rear face 2038 of rear cavity 2040.

Figure 21:
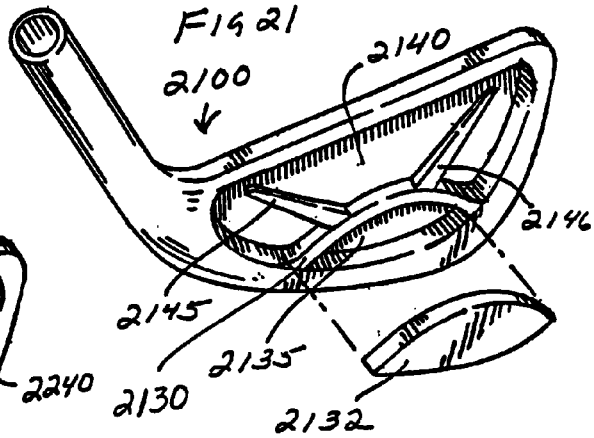

FIG. 21 shows a golf club head 2100 having a dominant secondary weight member 2130 generally arcuate in shape and formed with a cavity 2135. A tungsten insert 2132 is secured in the cavity 2135 located on a lower portion of rear face 2140. Auxiliary reinforcing and stabilizing weights 2145 and 2146 extend upwardly from an outer surface of secondary weight member 2130 across the rear face 2140.

Figure 22:
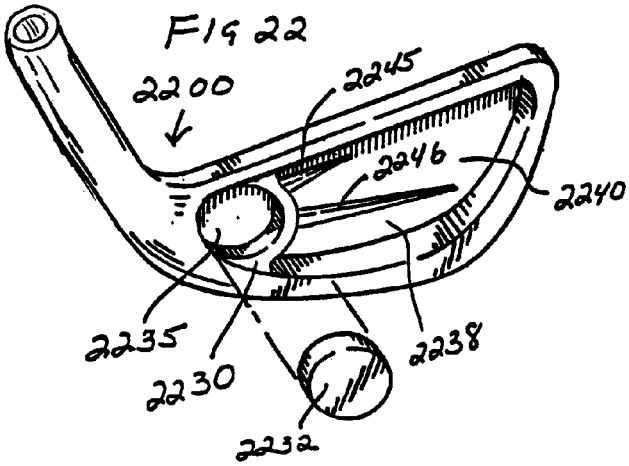

FIG. 22 shows a golf club head 2200 having a dominant secondary weight member 2230, generally round in shape and formed with a cavity 2235 and located on a heel portion of rear face 2240. A tungsten insert 2232 is secured in the cavity 2235. Auxiliary reinforcing and stabilizing members 2245 and 2246, having different lengths respectively extend outwardly from secondary weight member 2230 across rear face 2238 of rear cavity 2240.

Figures 23, 24, 25, 26:
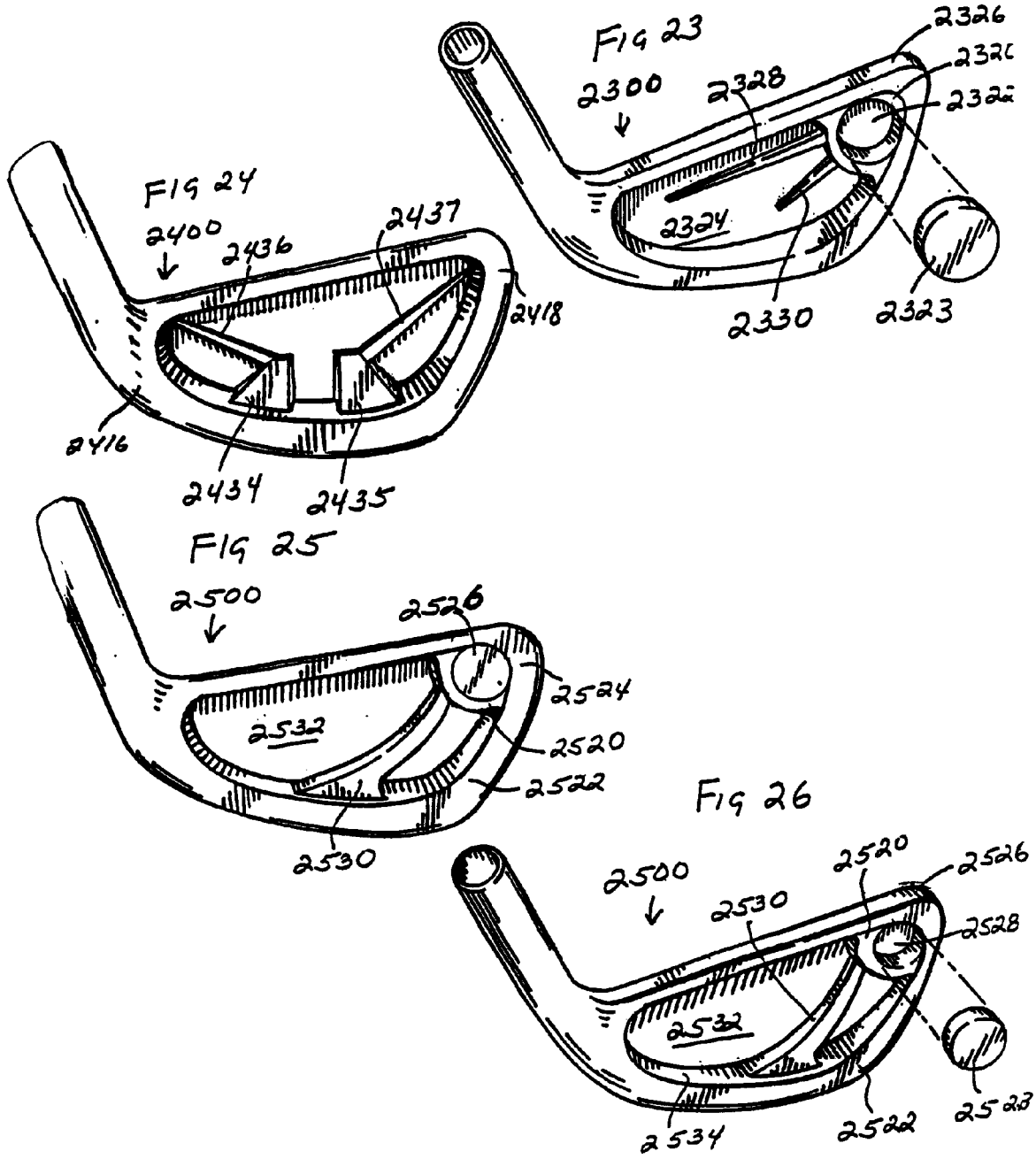

FIG. 23 shows a golf club head 2300 having a dominant secondary weight member 2320, and formed with a cavity 2322 generally round in shape and located on rear face 2324 adjacent upper toe portion 2326 of the club head 2300. A tungsten insert 2323 is secured in the cavity 2322. Auxiliary reinforcing and stabilizing weights 2328 and 2330 of different lengths extend across rear face 2324 from the secondary weight member 2320.

FIG. 24 shows a golf club head 2400 in accordance with the present invention including a pair of opposing secondary weight members 2434 and 2435 which form a split trapezoidal shape. Auxiliary reinforcing and stabilizing weights 2436 and 2437 extend from secondary weight members 2434 and 2435 respectively toward the heel 2416 and toe 2418 of the club head 2400.

FIGS. 25 and 26 show still another embodiment of a golf club head 2500 in accordance with the present invention. A secondary weight member 2520 is integrally formed with peripheral weight 2522 at an upper toe area 2524 of the club head 2500. The secondary weight member 2520 includes a round cavity 2528 and a tungsten insert 2526, which fits into the cavity 2528. An arcuate auxiliary reinforcing and stabilizing weight member 2530 is integrally formed on rear face 2532 and extends downwardly between secondary weight member 2520 and a shelf 2534 on a lower portion of peripheral weight 2522.

Figure 27:
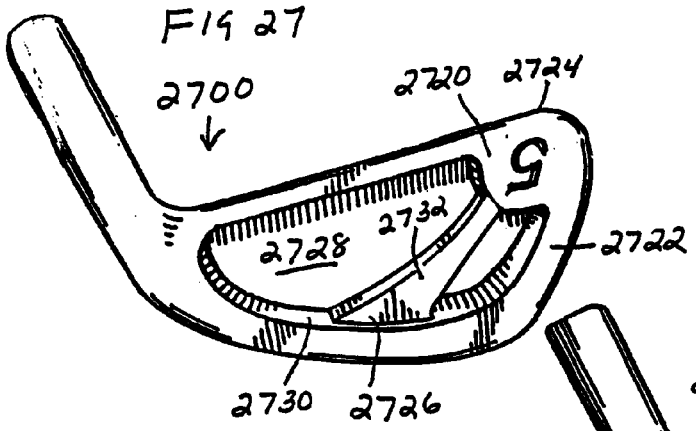

FIG. 27 shows an embodiment of a golf club head 2700 having a dominant secondary weight member 2720 integrally formed with peripheral weight 2722 at an upper toe area 2724 An auxiliary reinforcing and stabilizing member 2726, integrally formed on rear face 2728, extends downwardly between the secondary weight member 2720 and a shelf 2730 of peripheral weight 2722. The auxiliary reinforcing and stabilizing member 2726 includes a curved, arcuate surface 2732 which forms an upper side edge thereof.

Figure 28:
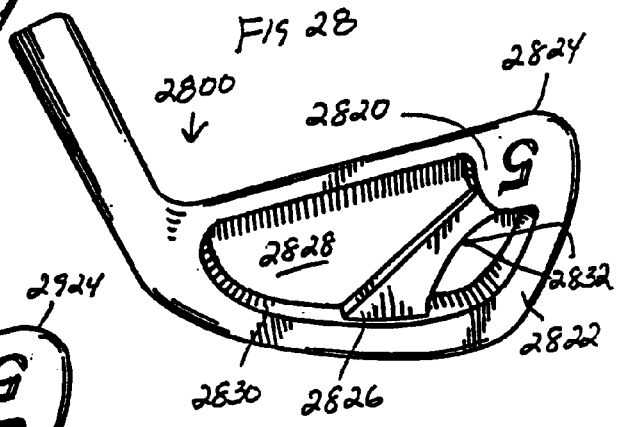

FIG. 28 shows an embodiment of a golf club head 2800 having a dominant secondary weight member 2820 integrally formed with peripheral weight 2822 at an upper toe area 2824 An auxiliary reinforcing and stabilizing member 2826, integrally formed on rear face 2828, extends downwardly between the secondary weight member 2820 and a lower shelf 2830 of peripheral weight 2822. The auxiliary reinforcing and stabilizing member 2826 includes a curved surface 2832 which forms a lower side edge thereof.

Figure 29:
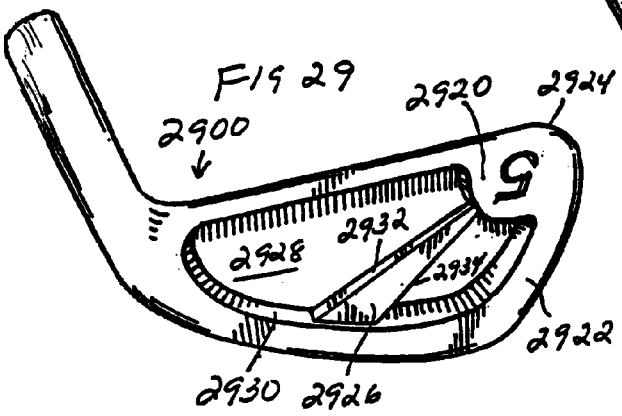

FIG. 29 shows an embodiment of a golf club head 2900 having a dominant secondary weight member 2920 integrally formed with peripheral weight 2922 at an upper toe area 2924. An auxiliary reinforcing and stabilizing weight member 2926, integrally formed on rear face 2928, downwardly from the secondary weight member 2920 and a lower shelf 2930 of peripheral weight 2922. The auxiliary reinforcing and stabilizing member 2926 includes upper and lower side edges 2932 and 2934 which are linear and which taper upwardly toward the secondary weight member 2920.

Figure 30:
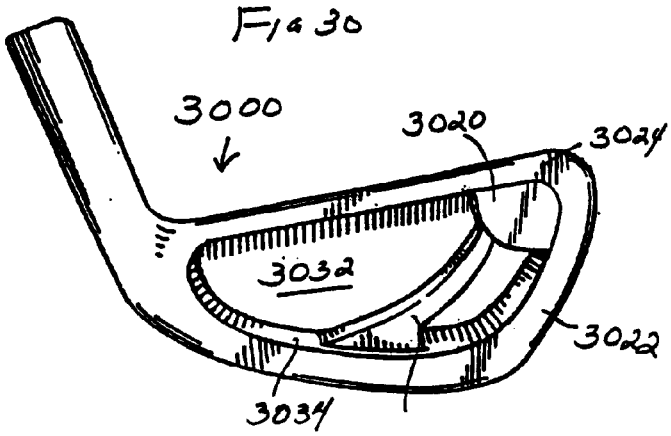

FIG. 30 shows an embodiment of a golf club head 3000 including a secondary weight member 3020 integrally formed with peripheral weight 3022 at an upper toe area 3024 of the club head 3000. An auxiliary reinforcing and stabilizing member 3030 is formed on the rear face 3032 between secondary weight member 3020 and a shelf 3034 on a lower portion of peripheral weight 3022.

Figure 31:
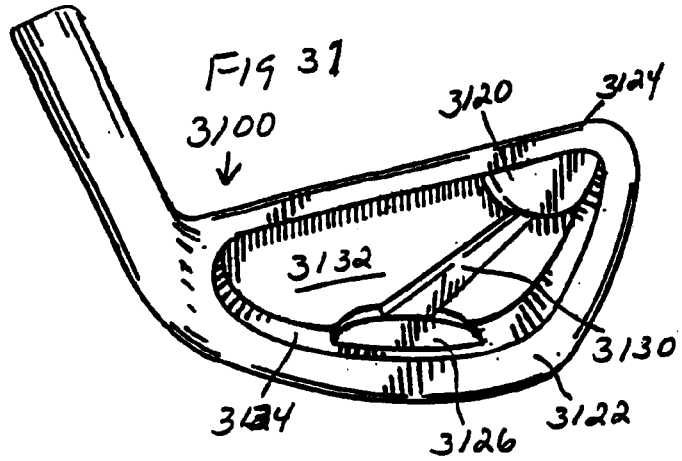

FIG. 31 shows a bar-bell shaped embodiment of a golf club head 3100 including a dominant secondary weight member 3120 integrally formed at an upper toe area 3124 of the club head 3100 and another dominant secondary weight member 3126 formed on a lower shelf 3134 of peripheral weight 3122 of the club head 3100. An auxiliary reinforcing and stabilizing member 3130 is formed on the rear face 3132 between secondary weight member 3120 and secondary weight member 3126.

Figure 32:
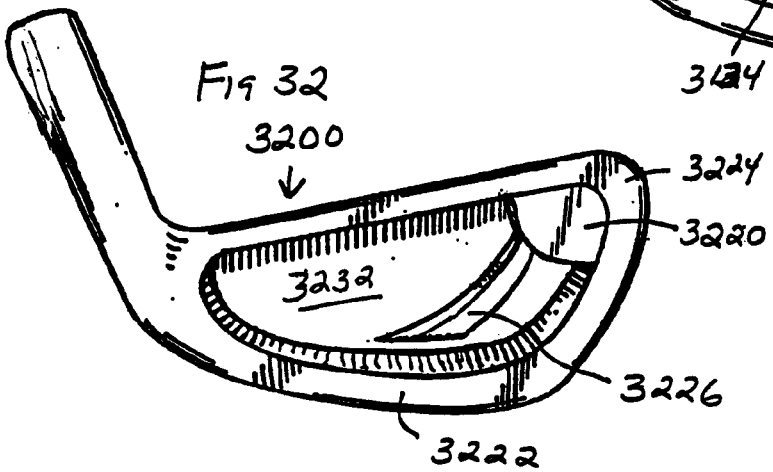

FIG. 32 shows an embodiment of a golf club head 3200 including a secondary weight member 3220 integrally formed at an upper toe area 3224 of the club head 3200. An auxiliary reinforcing and stabilizing member 3226 is formed on the rear face 3232 extending downwardly from secondary weight 3220 toward, but not touching, lower peripheral weight 3222.

Figure 33:
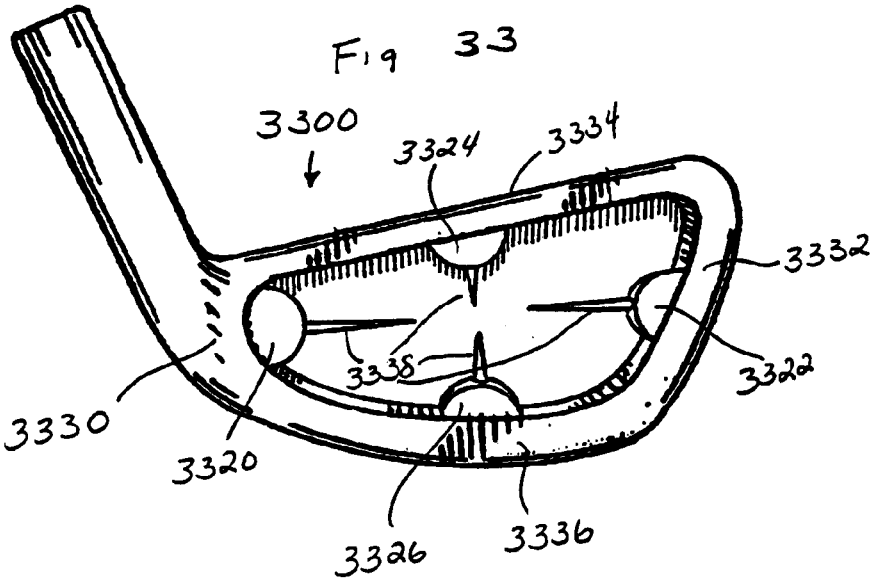

FIG. 33 shows an embodiment of a golf club head 3300 including four opposing, secondary weight members 3320, 3322, 3324 and 3326 integrally formed on rear face 3328 adjacent heel 3330, toe 3332 area, upper top ridge 3334, and bottom sole 3336 of the club head 3300. Four opposing auxiliary reinforcing and stabilizing weight members 3338 extend outwardly onto the rear face 3328 from each of the four opposing, secondary weight members 3320, 3322, 3324 and 3326.

While various preferred embodiments have been shown and described, it will be understood that there is no intent to limit the invention by such disclosure, but rather, is intended to cover all modifications and alternate constructions falling within the spirit and scope of the invention as defined in the claims.

What is claimed is:

1. An iron type golf club head including a hosel, heel, toe, bottom sole, top ridge surface, ball striking face having a centrally located ball impact zone and a primary peripheral weight formed rearwardly on said club head creating a back cavity having a rear face and upper, side and lower shelf surfaces wherein the improvement comprises:

a secondary weight and reinforcing system including a dominant secondary weight member and at least two smaller auxiliary, reinforcing and stabilizing weight members, in combination therewith; said secondary weight and reinforcing system located on said rear face; said dominant secondary weight member located adjacent to a portion of said primary peripheral weight and said auxiliary, reinforcing and stabilizing weight members extending from said dominant secondary weight member onto said rear face within said back cavity toward and spaced from portions of said primary peripheral weight opposite said dominant secondary weight member; said auxiliary, reinforcing and stabilizing weight members formed with an elongated shape, extending away from said dominant secondary weight member into said back cavity of said rear face;

and, at least one of said plurality of auxiliary, reinforcing and stabilizing weight members being centrally located adjacent a center area of said rear cavity behind said centrally located impact zone of said ball striking face, and at least one additional of said auxiliary, reinforcing and stabilizing weight members extending onto said rear cavity in a direction away from said center area of said rear cavity.

2. The golf club head of claim 1 wherein said dominant secondary weight member is integrally formed with said primary peripheral weight.

3. The golf club head of claim 1 wherein said auxiliary, reinforcing and stabilizing weight members are tapered in a direction away from said dominant secondary weight member.

4. The golf club head of claim 2 wherein said dominant secondary weight member is located on said lower shelf surface of said primary peripheral weight approximately midway between said heel and said toe.

5. The golf club head of claim 2 wherein said dominant secondary weight member is located on a toe side shelf surface of said primary peripheral weight.

6. The golf club head of claim 2 wherein said dominant secondary weight member is located on a heel side shelf surface of said primary peripheral weight.

7. The golf club head of claim 2 wherein said dominant secondary weight member is located on said upper shelf surface of said primary peripheral weight.

* * * * *